United States Patent [19]

Suzuki

[11] Patent Number: 4,813,318

[45] Date of Patent: Mar. 21, 1989

[54] PRESS TYPE CUTTING MACHINE FOR FABRIC

[75] Inventor: Seiichi Suzuki, Ohta, Japan

[73] Assignee: Daisuzu Kogyou Co. Ltd, Gunma, Japan

[21] Appl. No.: 81,679

[22] Filed: Aug. 5, 1987

[51] Int. Cl.[4] ..... B26D 5/08

[52] U.S. Cl. ..... 83/533; 83/550; 83/566; 83/696

[58] Field of Search ..... 83/531, 532, 533, 534, 83/696, 657, 566, 49, 549, 550, 551, 467; 269/8

[56] References Cited

U.S. PATENT DOCUMENTS

| | | | |
|---|---|---|---|
| 38,496 | 5/1863 | Maloy | 83/566 |
| 236,162 | 1/1881 | James | 83/467 |
| 451,434 | 4/1891 | Plummer | 83/467 |
| 793,011 | 6/1905 | Miller | 83/696 |
| 2,100,847 | 11/1937 | Halstead | 83/696 |
| 2,411,016 | 11/1946 | Azzara | 83/696 |
| 3,166,771 | 1/1965 | Kline et al. | 269/8 |
| 3,635,115 | 1/1972 | Rickenbacher | 83/696 |
| 3,826,170 | 7/1974 | Jones et al. | 83/696 |
| 4,344,342 | 8/1982 | Garvin | 83/49 |

*Primary Examiner*—Frank T. Yost
*Assistant Examiner*—Scott A. Smith
*Attorney, Agent, or Firm*—Fred Philpitt

[57] ABSTRACT

The cutting device is composed of a press cutting plate installed liftably at a cutting position, a cutting table installed to slide and shift in a horizontal direction in the upper part of the press cutting plate, and pattern plates setting a predetermined cutting line in each cutting region and being provided on the cutting table having at least two cutting regions, and cutters made of hoop material are individually formed in correspondence to the respective cutting lines of the pattern plates, and a plurality of cutters are sandwiched by fixing members along each cutting line of the pattern plates to be fixed on the cutting table, and the cutting table classifies the cutting lines of the fabric to be cut into the lines of the lateral direction and the lines of the vertical direction, and the cutting line of the vertical direction is set in one cutting region, and the cutting line of the lateral direction is set in the other cutting region and the cutting operation is carried out for each cutting region of the cutting table by shifting the cutting table.

2 Claims, 4 Drawing Sheets

PRESS TYPE CUTTING MACHINE FOR FABRIC

BACKGROUND OF THE INVENTION

This invention relates to a press type cutting machine for fabric which cuts each part of a clothing from knitted goods and other fabrics, namely, front body, rear body, sleeve, pocket and other members by using a press means, and more particularly to a press type cutting machine for fabric in which a pressure cutting plate is liftably provided and a cutting table is provided slidably and shiftably in a horizontal direction in the upper part of the pressure cutting plate, and the cutting table is at least provided with two cutting regions, and a pattern plate is formed by separating the cutting lines of the fabric to be cut according to directions and setting the cutting lines for each cutting line of the same direction, and the pattern plate is fixed in the predetermined cutting region of the cutting table, and cutters made of hoop are formed for each cutting line set on the pattern plate and the cutters are fixed on the cutting table along each cutting line of the pattern plate, and the cutting table is shifted for each cutting region whereby the cutting operation is taken place for each cutting region.

Heretofore, there was provided press type cutting machines in which the fabric to be such as knitted goods and the like was mounted on the cutting table and the cutter was pressed from the upper direction, but the cutter to be used in the cutting machine of the conventional press type of this kind was provided to meet with a pattern matched with each part of the clothing, for example, front body, rear body, sleeve, pocket and other fabrics to be cut, and it had been very difficult to form a curve line to produce a desired cutter by cutting a metal blank and it required a skilled technique, and therefore, its manufacturing costs became extremely expensive. Also, in case of forming the cutter by using the hoop material, the shape of the cutter was made by forming a piece of the hoop material to an endless type by bending it to a shape along a desired set line and by fusing both ends thereof, and the cutter was fixed on the cutting table by means of fusing or set screws, and the cutter fixed on the cutting table by means of fusing or set screws, and the cutter fixed on the cutting table was such that the exchange of the cutter only was impossible in case of replacing it due to wear and tear so that the cutter had to be replaced together with the cutting table, and also, since the cutter was shaped in correspondence to the specifically set line for each fabric to be cut causing it necessary to prepare a cutter shaped to a separate shape in case the set line was slightly different, and moreover, the cutter made of the hoop material lacked an accuracy when the cutter was fused or fixed by set screws to the predetermined set line, and particularly, the fixing of the cutter accurately along the curve line was extremely difficult, and moreover, the cutting portion of connected portion of both ends formed in endless type tended to be broken by the fusing and the uncut portion remained in this portion which were drawbacks.

SUMMARY OF THE INVENTION

An object of this invention is to provide a cutting device in which a pattern plate is prepared by separating the cutting lines of the fabric to be cut according to directions, for example, having cutting lines for each identical direction so that the lateral directions or the vertical directions are grouped, and the cutter made of the hoop material is individually prepared for each cutting line set on the pattern plate, and the pattern plates whose cutting lines are different for each cutting region of the cutting table are provided and the respective cutters are fixed along each cutting line of each pattern plate, and the cutting table is slidably and shiftably provided in horizontal direction to perform the cutting for each cutting region of the pattern plate, and thus, the formation of the cutter is extremely easy and simple and at the same time, the installation of the cutter is easy and simple and moreover, the exchange of the cutter is easy and simple.

Another object of this invention is to provide a cutting device in which a pattern plate is prepared by separating cutting lines of the fabric to be cut according to directions and having the cutting line for each identical direction so that the lateral directions or the vertical directions are grouped, and the cutter made of hoop material is shaped individually for each cutting line set on the pattern plate, and for example, in a contour line of the fabric to be cut, a pattern plate having a cutting line of the lateral direction and a pattern plate having a cutting line of the vertical direction are prepared, and the cutter set in each cutting line is shaped so that its both ends are extended and projected outward of the contour line, and when the fabric to be cut is cut for each cutting region so that the cutting lines of the lateral direction and of the vertical direction are intersected whereby the entire contour of the fabric to be cut is completely cut and the uncut portion does not remain and the cutting is made completely.

DETAILED DESCRIPTION OF THE INVENTION

Figure 1:
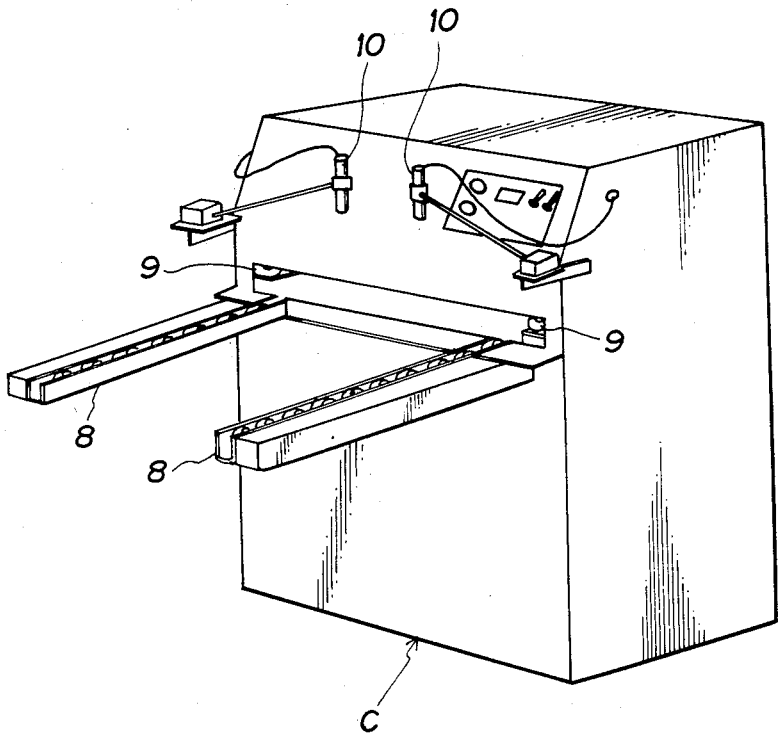
FIG. 1 is a perspective drawing of a cutting device.
Figure 2:
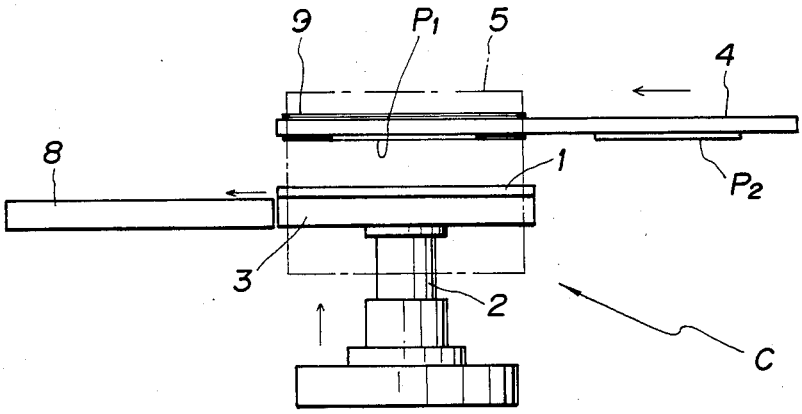
FIG. 2 is an elevation showing a cutting position of the first time.
Figure 3:
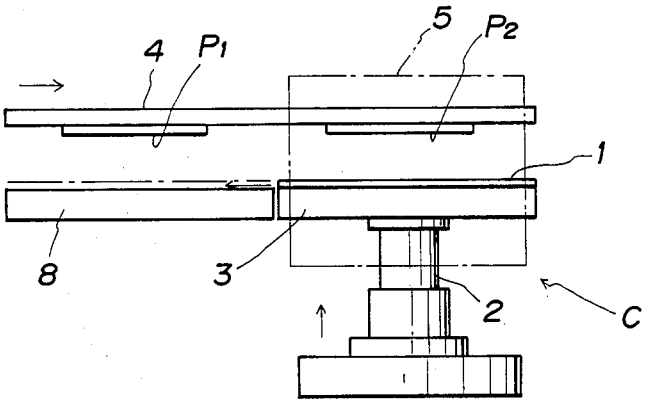
FIG. 3 is an elevation showing a cutting position of the second time.
Figure 4:
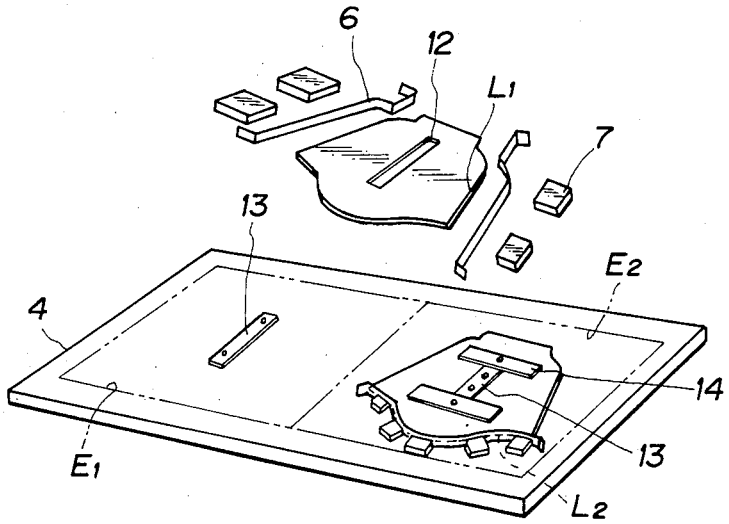
FIG. 4 is a perspective drawing showing the cutting table, pattern plate and cutter and a fixing member separately.
Figure 5:
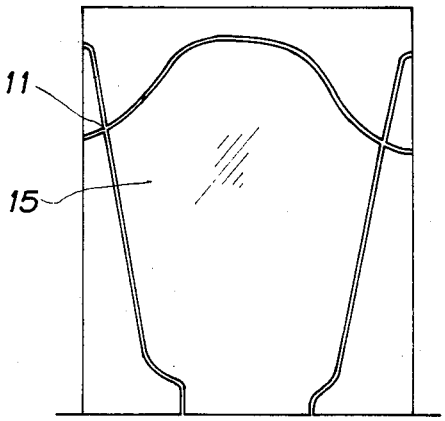
FIG. 5 is a plan showing the cut condition of the sleeve.

The cutting device according to this invention which is shown by an ordinary letter C is installed on a lifting table 3 that moves the press cutting plate 1 by means of the cylinder 2, and the cutting table 4 is installed on the upper part of the pressure cutting plate 1, and the cutting table 4 is provided with two cutting regions $E_1$, $E_2$ enclosed by two-dot chain lines, and the cutting table 4 is slidably and shiftably moved in a horizontal direction to move from each cutting region $E_1$ to cutting region $E_2$ and to a cutting position 5 shown by one-dot chain line slidably and shiftably, and whenever each of cutting region $E_1$, $E_2$ is positioned at the cutting position 5, the pressure cutting plate 1 is lifted to perform the cutting operation, and pattern plates $P_1$, $P_2$ are removably installed on the cutting regions $E_1$, $E_2$ of the cutting table 4, and the pattern plates $P_1$, $P_2$ have the cutting lines that intersect mutually the contour of the sleeve of the desired fabric to be cut, for example, as shown in FIG. 5, namely, the lines are separated to the cutting line $L_1$ of the vertical direction and the cutting line $L_2$ of the lateral direction, and the cutting line of the vertical direction is set on the pattern plate $P_1$, and the cutting line $L_2$ of the lateral direction is set on the pattern plate $P_2$, and the cutters 6 of the hoop type are individually shaped along the cutting line $L_1$ of the vertical direction and the cutting line $L_2$ of the lateral direction set on the pattern plate $P_1$, $P_2$, and these cutters 6 are sandwiched along the pattern plate $P_1$, $P_2$, by a plurality of fixing elements 7 bearing the magnetism to be installed on the cutting table 4.

Reference numeral 8 denotes a work table adjacent to the lifting table 3 and having a horizontal surface identical with an upper surface of the lifting table 3, and 9 denotes a guide frame for slidably guiding the cutting table 4, and 10 denotes an optical marker to be used for positioning the pattern plates $P_1$, $P_2$ installed on the cutting table 4.

The cutters 6 are shaped to have a length to be extended at both ends of the cutting lines $L_1$, $L_2$ of the pattern plates $P_1$, $P_2$, and are preferably not to produce the uncut portion by the cutting 11 upon crossing extensions of the vertical line and the lateral line as shown in FIG. 5.

Accordingly, when the cutter 6 is installed on the cutting table 4, the cutter 6 made of the hoop material is properly bent in correspondence to the cutting lines $L_1$, $L_2$ set on the pattern plates $P_1$, $P_2$, but since there is no need of forming the cutter 6 in complete coincidence with the cutting lines $L_1$, $L_2$, no special fabrication is required, and the cutter 6 can be simply intalled on the cutting table 4 by merely sandwiching it by means of the fixing member 7 along the cutting lines $L_1$, $L_2$ of the pattern plates $P_1$, $P_2$, and particularly, it can be installed easily and accurately along the curve lines of the pattern plates $P_1$, $P_2$ in the curve lines. The pattern plates $P_1$, $P_2$ can be positively installed on the cutting table 4 without any movement by the stationary plate 13 and the holding plate 14 which fit the through hole 12 bored in the center portion, and the cutter 6 is sandwiched and fixed firmly on the cutting lines $L_1$, $L_2$ of the pattern plates $P_1$, $P_2$ by the fixing member 7 so that the cutter 6 does not fall off the cutting table 4 even if the cutting table 4 is set downward and can be firmly and positively installed.

In the cutting manipulation, in the first place, the cutting table 4 is placed on the work table 8, and the positioning of the pattern plates $P_1$, $P_2$ to be installed in each cutting region $E_1$, $E_2$ is carried out by the optical marker 10, and then, the cutting table 4 is installed on the guide frame 9 so that the cutter 6 becomes the under surface, and the first cutting region $E_1$ is set at the cutting position 5. Next, the fabric that is the goods to be cut is installed on the press cutting plate 1 positioned on the work table 8.

Now, when the device is switched on, the press cutting plate 1 is shifted and is mounted on the lifting table 3 and is shifted and positioned at the cutting position 5, and the press cutting plate 1 is lifted to perform the first cutting operation and while the press cutting plate 1 is descended, the cutting table 4 is slidably moved to shift the next cutting region $E_2$ at the cutting position 5 by its sliding motion, and then, the press cutting plate 1 is lifted to perform the second cutting operation and when the press cutting plate 1 is descended, the cutting table 4 is retreated to shift the first cutting region $E_1$ at the cutting position 5, and at the same time, the press cutting plate 1 is returned to the work table 8 from the cutting position 5. At this stage, the cut fabric is recovered, and the new fabric to be cut is again placed on the press cutting plate 1 to complete one cycle of the cutting operation.

The pattern plates $P_1$, $P_2$ are set on the cutting regions $E_1$, $E_2$ whose cutting line $L_1$ of the vertical direction and the cutting line $L_2$ of the lateral direction of the contour line of the fabric to be cut, and the contour of the vertical direction is cut by the first cut, and the contour of the lateral direction is cut by the second cutting, whereby the fabric 15 to be cut of the desired shape is obtained. At the location where the vertical and lateral lines are crossed, the cutting lines $L_1$, $L_2$ are respectively extended and mutually crossed and extended to be cut 11 so that the complete cutting is taken place on account of no uncut portion.

Figure 6:
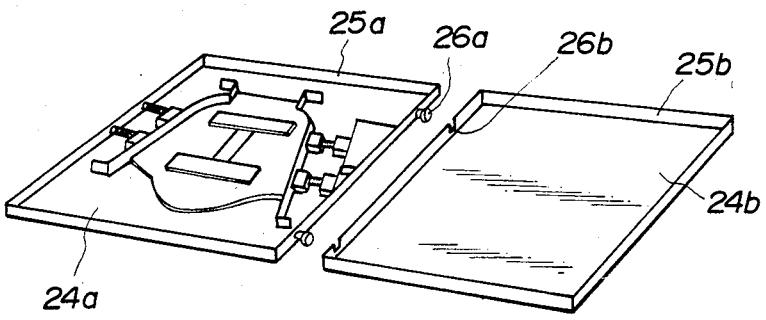
FIG. 6 is a perspective drawing in which another cutting table to this invention is shown, and the pattern plate and the cutter are installed on the cutting table.
Figure 7:
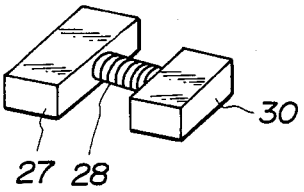
FIG. 7 is an enlarged perspective drawing of the fixing member.

By the way, FIGS. 6 and 7 show the cutting table and the fixing member of another embodiment according to this invention, and the cutting table 4 is individually formed of the cutting table 24*a* corresponding to the cutting region $E_1$ and the cutting table 24*b* corresponding to the cutting region $E_2$ by independent members, and each of the cutting table 24, 24*b* is formed with edges 25*a*, 25*b* rising on outer circumference, and is provided with a connecting member 26*a* and is provided with an engaging concave portion 26*b* of the connecting member 26*a* to form a mating whereby the handling of the cutting tables becomes easy by the connection of both the cutting tables 24*a*, 24*b*, and moreover, the fixing member 27 is provided integrally with the spring 28 bearing the magnetism, and the cutter 6 is sandwiched elastically to the cutting lines $L_1$, $L_2$ by utilizing the edges 25*a*, 25*b* of the cutting tables 24*a*, 24*b* or as shown in FIG. 7, an auxiliary fixing member 30 is provided on the other end of the spring 28 provided on the fixing member 27 to make the fixing more firm.

As described in the foregoing, this invention is to provide pattern plates having at least two cutting regions and being set in the predetermined cutting regions for each cutting line of identical direction by separating the cutting lines of the fabric to be cut according to directions, whereby the cutters made of the hoop material can be formed in an optional length, and moreover, the installation of the cutters can be simply and easily made by pressing and sandwiching the stationary magnets along the cutter very easily which can perform the cutting of all shapes by a simple and easy method not conceivable from the conventional cutters, and moreover this invention can facilitate the easy exchange of the cutters, and the positive cutting can be made without leaving the uncut portion which are advantageous points of this invention.

What is claimed is:

1. A cutting device for a press type cutting machine for fabric which includes (a) a press cutting plate (1) having a horizontal surface to support a fabric;

(b) a cutting table (4) positioned above said press cutting plate (1), said cutting table (4) being mounted so that it can slide horizontally in a plane parallel to said press cutting plate (1), (c) a first cutting region ($E_1$) located on said cutting table (4), (d) a second cutting region ($E_2$) located on said cutting table (4), (e) a first pattern plate ($P_1$) affixed to said first cutting region ($E_1$), (f) a second pattern pate ($P_2$) affixed to said second cutting region ($E_2$)

(g) a cutter (6) made of hoop material positioned along a first outer portion of said first pattern plate ($P_1$) so as to establish a first cutting line ($L_1$) for the fabric, (h) another cutter (6) made of hoop material positioned along a second outer portion of said second pattern plate ($P_2$) so as to establish a second cutting line ($L_2$) for the fabric, (i) holding means (7) to hold said cutters (6) firmly in position against the outer contours of said pattern plates ($P_1$ and $P_2$), said holding means comprising a fixing member (27) and a spring (28) operatively connected to an edge (**25*a*, 25*b*) of said cutting table, and (j) lifting means (2) for said press cutting plate (1) so that the press cutting plate (1) and a fabric supported on it can be alternately pressed against said first cutting region ($E_1$) when said first cutting region is positioned above said cutting plate (1) and subsequently against said second cutting region ($E_2$) when said second cutting region is positioned above said cutting plate (1**).

2. A cutting device according to claim 1 wherein said holding means are magnetic (7).

* * * * *